United States Patent [19]

Olivieri

[11] Patent Number: 4,470,205

[45] Date of Patent: Sep. 11, 1984

[54] TWO PIECE SKATE BOOT WITH INTEGRAL HINGE PIN

[75] Inventor: Icaro Olivieri, Montebelluna, Italy

[73] Assignee: Warrington Inc., Montreal, Canada

[21] Appl. No.: 469,836

[22] Filed: Mar. 2, 1983

Related U.S. Application Data

[63] Continuation of Ser. No. 177,634, Aug. 13, 1980, abandoned.

[51] Int. Cl.[3] ..... A43B 5/00; A43B 5/16; A43B 5/04

[52] U.S. Cl. ..... 36/114; 36/115; 36/120; 29/453

[58] Field of Search ..... 36/114, 115, 117–121; 29/453; 24/620, 617, 598, 117 G, 324

[56] References Cited

U.S. PATENT DOCUMENTS

| | | | |
|---|---|---|---|
| 2,177,232 | 10/1939 | Tinnerman | 29/453 UX |
| 2,948,937 | 8/1960 | Rapata | 29/453 UX |
| 3,067,531 | 12/1962 | Scott et al. | 36/120 |
| 3,631,584 | 1/1972 | Walkup . | |
| 3,868,783 | 3/1975 | Caporicci | 36/120 |
| 3,918,140 | 11/1975 | Konstant . | |
| 4,143,474 | 3/1979 | Blanc | 36/120 |

FOREIGN PATENT DOCUMENTS

| | | | |
|---|---|---|---|
| 363009 | 7/1981 | Austria . | |
| 811930 | 5/1969 | Canada . | |
| 889586 | 1/1972 | Canada . | |
| 918417 | 1/1973 | Canada . | |
| 921252 | 2/1973 | Canada . | |
| 931351 | 8/1973 | Canada . | |
| 938442 | 12/1973 | Canada . | |
| 2631398 | 2/1977 | Fed. Rep. of Germany | 36/120 |
| 2317890 | 2/1977 | France . | |
| 2351617 | 12/1977 | France | 36/121 |

*Primary Examiner*—James Kee Chi

*Attorney, Agent, or Firm*—Schwartz, Jeffery, Schwaab, Mack, Blumenthal & Koch

[57] ABSTRACT

A hinged sport boot having an upper boot portion with hinge openings in its sides and a lower boot portion with integral, headed, hinge pins projecting from its sides. The heads of hinge pins are slightly larger in size than the openings so that the pins must be forced through the openings to hingedly connect the upper and lower portions together. A locating depression is provided on the central outer surface of the head of each pin to properly locate a connecting tool used to connect the boot portions together. The invention is also directed toward a method for connecting the boot portions together.

4 Claims, 5 Drawing Figures

TWO PIECE SKATE BOOT WITH INTEGRAL HINGE PIN

This application is a continuation of Ser. No. 177,634, filed Aug. 13, 1980, now abandoned.

BACKGROUND OF THE INVENTION

1. Field of the Invention

This invention is directed toward improvements in sport boots facilitating their manufacture.

The invention is also directed toward a method for use in manufacturing sport boots.

2. Description of the Prior Art

The invention is particularly directed toward improvements in sport boots of the type having an upper boot portion hingedly connected to a lower boot portion. Such a construction is employed in sport boots made from rigid material such as molded thermoplastic material. The rigid, hinged boot allows the wearer to bend his legs at the ankles.

A hinge is provided on each side of the boot connecting the upper and lower boot portions together in the ankle region. The hinge normally is comprised of a separate rivet or like member. The use of these separate hinge members however increases boot assembly time and cost.

It is known to provide sport boots having integral hinges. Such integral hinges are shown by way of example in U.S. Pat. Nos. 3,538,627; 3,793,747 and 4,019,267. However, the use of integral hinges often still requires additional means to hold the upper and lower boot portions together. U.S. Pat. Nos. 3,538,627 and 3,793,747 show such additional means. The boot shown in U.S. Pat. No. 3,538,627 requires nuts and washers to complete the connection between the upper and lower boot portions. The boot shown in U.S. Pat. No. 3,793,747 requires clips at the back of the upper boot portion to lock it in place on the hinges.

SUMMARY OF THE INVENTION

The present invention is directed toward sport boots employing integral hinges of the type requiring no separate means to hold the upper and lower boot portions together. The hinge construction itself provides the means to hold the boot portions together. Such a construction is shown in U.S. Pat. No. 4,019,267. In this type of construction the upper boot portion, with hinge openings in its sides, is assembled to the lower boot portion, with headed hinge pins projecting from its sides by forcing each head of a hinge pin through the respective hinge openings. As far as is known the headed pins are anually forced through the openings one at a time to hingedly connect the upper and lower boot portions together. The manual assembly operation is time consuming.

It is the purpose of the present invention to provide an improved hinged sport boot of the type having integral hinge means which improved boot has means to facilitate the assembly of the boot portions mechanically thereby making the assembly job easier and quicker.

It is another purpose of the present invention to provide a faster method for assembling a hinged sport boot of the type having integral hinge means.

In accordance with the present invention, the integral hinge pins on the improved boot are each provided with locating means. The locating means serve to locate a connecting tool or machine in the proper position to mechanically force the headed hinge pin on the lower boot portion through an opening on the upper boot portion. The locating means preferably comprises a central, shallow depression on the outer face of each pin.

To further improve the assembly of the boot portion, at least the head of the hinge pin, and preferably the surface of the upper portion adjacent the openings, are shaped in a manner to facilitate insertion of the hinge pin head through the opening.

The invention is particularly directed toward a hinged sport boot having a lower foot covering portion and an upper, ankle covering portion. An integral hinge pin projects outwardly from each side of the lower portion, each pin having an enlarged head spaced from the lower portion. A hinge opening is provided on each side of the upper portion, each opening slightly smaller in size than the size of the enlarged head of the hinge pin. Means are provided on each hinge pin for use in hingedly connecting the upper boot portion to the lower boot portion by forcing the heads of the hinge pins through the openings.

The invention is also directed toward a method of hingedly connecting an upper sport boot portion to a lower sport boot portion. The upper sport boot portion has a hinge opening on each side and the lower sport boot portion has an outwardly projecting, integral, hinge pin on each side, each hinge pin having an enlarged head slightly larger in size than the hinge openings. The method has the steps of: positioning the upper portion over the lower portion with the openings concentric with the heads of the hinge pins; locating a pushing member to be concentric about at least one of the hinge pin heads; and operating the pushing member to move toward the lower portion to push the upper portion against the lower portion with the head of the one hinge pin forced through the associated opening.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
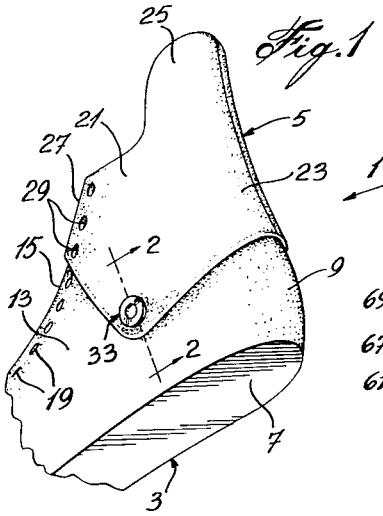
FIG. 1 is a perspective view of a sport boot incorporating the present invention.

The hinged sport boot 1 of the present invention comprises a lower, foot-covering, portion 3 and an upper, ankle-covering portion 5. The upper and lower boot portions 3, and 5 may be integrally connected together at the back of the boot with an expansible portion. Preferably however the upper and lower boot portions 3 and 5 comprise separate members. The lower boot member 3 has a sole 7, a heel 9, a toe 11, and sides 13 connecting the toe and heel together. The upper edges 15 of the sides 13 define an opening 17 between them in the instep area. A row of closure eyelets 19 is provided in each side 13 adjacent its upper edge 15 alongside the opening 17.

The upper boot member 5 has a pair of sides 21 joined by a back 23. The upper member 5 can have an extension 25 projecting up from its top, rear portion to provide a tendon guard when the sport boot is employed in an ice skate. The upper, front edges 27 of the sides 21 define a continuation of opening 17 between them. A short row of eyelets 29 is provided in each side 21 adjacent each edge 27, the eyelet rows 29 forming a continuation of eyelet rows 19 in the lower member 3.

The bottom portion of the upper boot member 5 is constructed to overlie the upper portion of the bottom boot member 3. Means are provided for hingedly connecting the upper member 5 to the lower member 3. The connecting means include an integral hinge pin 33 projecting outwardly from each side 13 of the lower member 3. The hinge pin 33 preferably is located in the area just below the ankle when the boot is being worn. Each hinge pin 33 includes a short shank portion 35 and a head portion 37 having a diameter slightly larger than the diameter of the shank portion 35. The shank portion 35 has a length equal to, or just slightly greater than, the thickness of the sides 31 of the upper member 5. The head portion 37 of the hinge pin 33 has a thickness substantially equal to the length of the shank portion 35.

Figure 2:
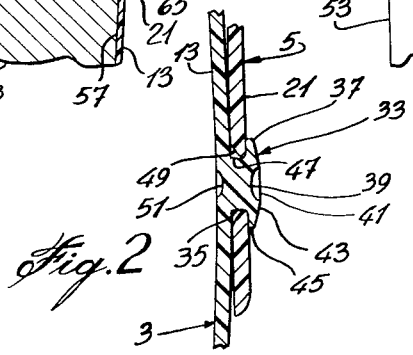
FIG. 2 is a cross-section view taken along line 2—2 of FIG. 1.

Each hinge pin 33 is provided with means for use in connecting the upper and lower boot members together. These means comprise a locating depression or dimple 39 in the center of the outwardly facing surface 41 of the head portion 37 of the hinge pin 33. The locating dimple 39 is relatively shallow and is used to receive a centering pin to properly locate a connecting tool as will be described. In addition, the head portion 37 of each hinge pin 33 can be slightly bevelled, as shown at 43 in FIG. 2, towards its outer edge 45. The bevelled surface 43 helps in the assembly of the boot members 3, 5 as will be described.

The upper member 5 has a hinge opening 47 in the bottom, central area of each side 21. The openings 47 are preferably circular in shape and sized to be smaller in diameter than the diameter of the enlarged head portion 37 of the hinge pin 33 and slightly larger in diameter than the diameter of the shank portion 35. Preferably the inside surface of each side 21 surrounding the opening 47 is bevelled, as shown at 49 in FIG. 2, to help in assembling the boot members 3, 5.

A shallow locating depression or dimple 51 is provided on the inner surface of each side 21 of the lower member 3. The inner locating depressions 51 on the lower member 3 are located opposite each other and are preferably aligned with the outer locating depressions 39 in the integral hinge pins 33.

Figure 3:
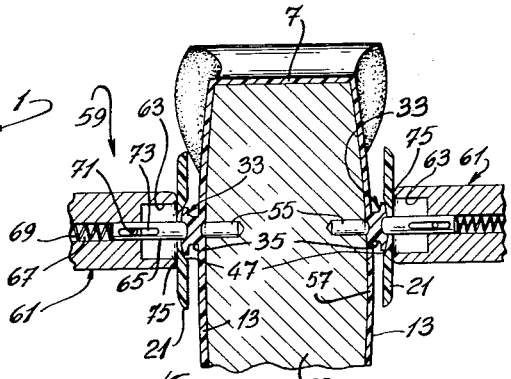
FIG. 3 is a cross-section view showing the upper boot member in position about to be connected to the lower boot member.
Figure 4:
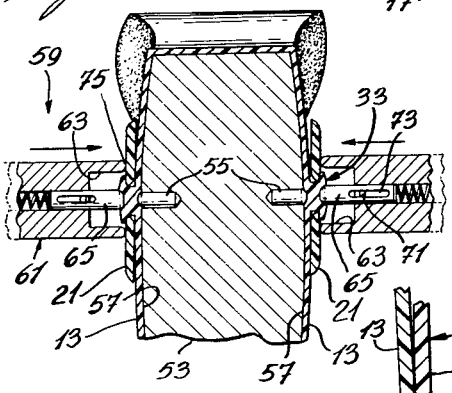
FIG. 4 is a cross-section view showing the upper boot member just after it has been connected to the lower boot member.
Figure 5:
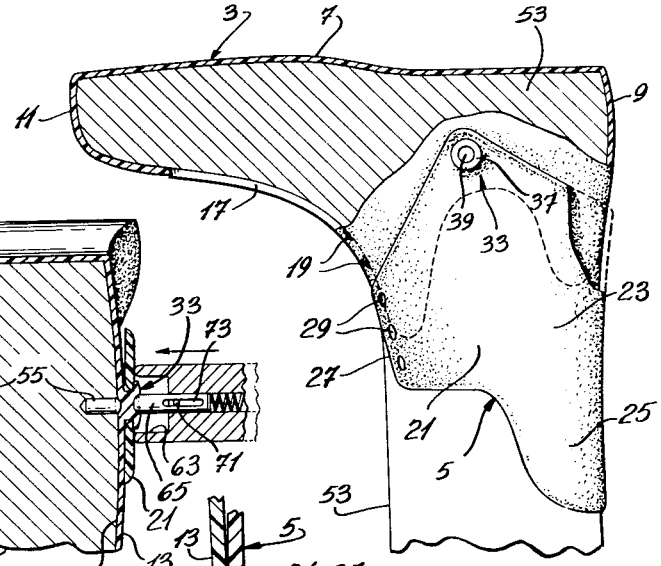
FIG. 5 is a partial cross-section view of the sport boot on the last with the upper and lower boot members connected together.

To assemble the lower and upper boot members 3, 5 together, a last 53 is inserted into the lower member 3. The last 53 has a pair of pins 55 projecting out slightly from its sides 57. The pins 55 are located to fit within the inner locating depressions 51 within the lower boot member 3 when the last 53 is properly positioned within the member 3. The upper boot member 5 is now positioned about the lower boot member 3 and the last 53 with the openings 47 in the upper boot member overlying the heads 37 of the hing pins 33 as shown in FIG. 3.

The last 53 carrying both members 3, 5 is now positioned relative to a connecting tool 59. The connecting tool 59 has a pair of opposed pusher heads 61. Each pusher head 61 has a circular porjecting rim 63. The rim 63 is slightly larger in inner diameter than the outer diameter of the head portion 37 of the hinge pin 33. Each pusher head 61 also has a locating pin 65 projecting axially out of the pusher head and centrally located within the rim 63. The locating pin 65 normally projects just past the front edge of the rim 63. The pin 65 is slidably mounted within a central bore 67 in the pusher head 61. A spring 69 within bore 67 biases the pin 65 outwardly. A retaining pin 71 located within bore 67, passes through a slot 73 in the locating pin 65 to retain the locating pin 65 within the pusher head 61.

With the last 53 generally positioned within the connecting tool 59, the pusher heads 61 are located on opposite sides of the last 53 generally opposite the pins 33. The pusher heads 61 are now moved inwardly to properly position the locating pins 65 within the locating depressions 39 in the head portions 37 of the hinge pins 33. When the locating pins 65 are located within the depressions 39, the rims 63 are concentric about the head portions 37 of the pins 33. The leading edge 75 of each rim 63 bears on the outer surface of each side 21 of the upper member 5. When the pusher heads 61 are now pushed toward the last 53, the rims 63 force the sides 21 of the upper member 5 toward the sides 13 of the bottom member 3 with the heads 37 of the hinge pins 33 resiliently forced through the openings 47. The bevelled surfaces 43, 49 help the head 37 of the pin 33 move concentrically through the opening 47. Once the head of the pin 33 snaps through the opening 47 the pusher heads 61 are withdrawn and the lasted boot is removed from the connecting tool 59.

The boot members 3, 5 are preferably molded from suitable thermoplastic material. While the connecting machine 59 has been described as having a pair of opposed pusher heads 61 which operate simultaneously toward and away from each other, the connecting machine can also comprise a single pusher head 61 acting first on one side and then on the other side of the lasted boot.

I claim:

1. A hinged sport boot having a lower, foot covering portion and an upper, ankle covering portion;

an integral hinge pin projecting outwardly from each side of the lower portion, each pin having an enlarged head spaced from the lower portion and having an outwardly facing surface;

a hinge opening on each side of the upper portion, each opening slightly smaller in size than the size of the enlarged head of the hinge pin;

and means on each hinge pin for use in hingedly connecting the upper portion to the lower portion by forcing the heads of the pins through the openings, said means comprising a locating depression in the center of the outwardly facing surface of the hinge pin head for use in locating a connecting tool, and last locating means on the inner surface of the lower boot portion, the last locating means being aligned with the locating depressions in the heads of the hinge pins.

2. A hinged sport boot as claimed in claim 1 including a bevelled surface on each hinge pin head about the locating depression.

3. A hinged sport boot as claimed in claim 1 wherein the inside surface of each side of the upper boot portion is bevelled about the opening.

4. A hinged sport boot as claimed in claim 2 wherein the inside surface of each side of the upper boot portion is bevelled about the opening.

* * * * *